US006249982B1

(12) United States Patent
Zaiser

(10) Patent No.: US 6,249,982 B1
(45) Date of Patent: Jun. 26, 2001

(54) HAND PLANER

(75) Inventor: Adolf Zaiser, Koengen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/403,816

(22) PCT Filed: Mar. 25, 1998

(86) PCT No.: PCT/DE98/00869

§ 371 Date: Oct. 26, 1999

§ 102(e) Date: Oct. 26, 1999

(87) PCT Pub. No.: WO98/48985

PCT Pub. Date: Nov. 5, 1998

(30) Foreign Application Priority Data

Apr. 26, 1997 (DE) ..... 197 17 706

(51) Int. Cl.[7] ..... B27C 1/10
(52) U.S. Cl. ..... 30/475; 144/230; 144/241
(58) Field of Search ..... 30/475–477; 144/230, 144/114.1, 117.1, 241; 409/345, 346, 308; 407/66, 67

(56) References Cited

FOREIGN PATENT DOCUMENTS 915 265 7/1954 (DE) .
29608603 * 9/1996 (DE) .
19536559 * 4/1997 (DE) .
0 117 991B1 9/1987 (EP) .
2 477 460 4/1986 (FR) .

* cited by examiner

*Primary Examiner*—Douglas D Watts
(74) *Attorney, Agent, or Firm*—Michael J. Striker

(57) ABSTRACT

A manual planing machine, has a planer shaft having at least one longitudinal slot, an elongated flat planer knife clamped in a detachable manner in the and formed as a dual-cutting mini reversible tip with at least one cutter and with a back groove extending parallel to the cutter and with a holding rib on a side of the longitudinal slot to prevent an intentional detachment from the planer shaft, the planer knife carrying only one the cutter, extending in a corrugated manner in such a way that troughs of the cutter lie on a common first straight line having the same spacing relative to the back groove as a cutter of a mini reversible tip, while its crest lie on a common second straight line which extends 0.5–1.5 mm radially above the first straight line, the planar knife carrying a contact edge which is right-tangled and is flattened relative to a back, instead of another cutter at a side located opposite from the at least one cutter for support at the radial stop of the planar shaft.

16 Claims, 3 Drawing Sheets

FIG. 2
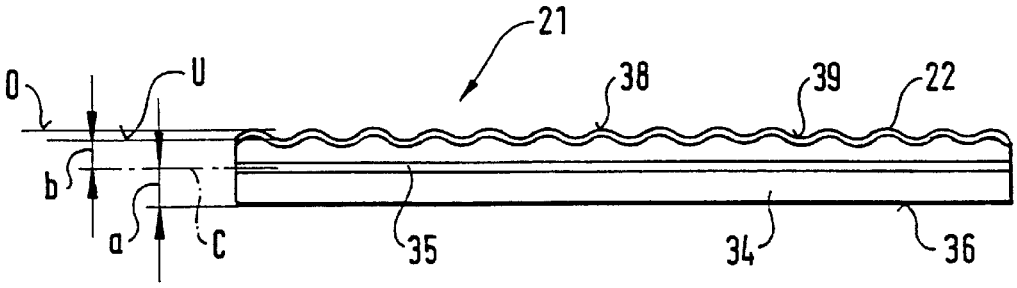
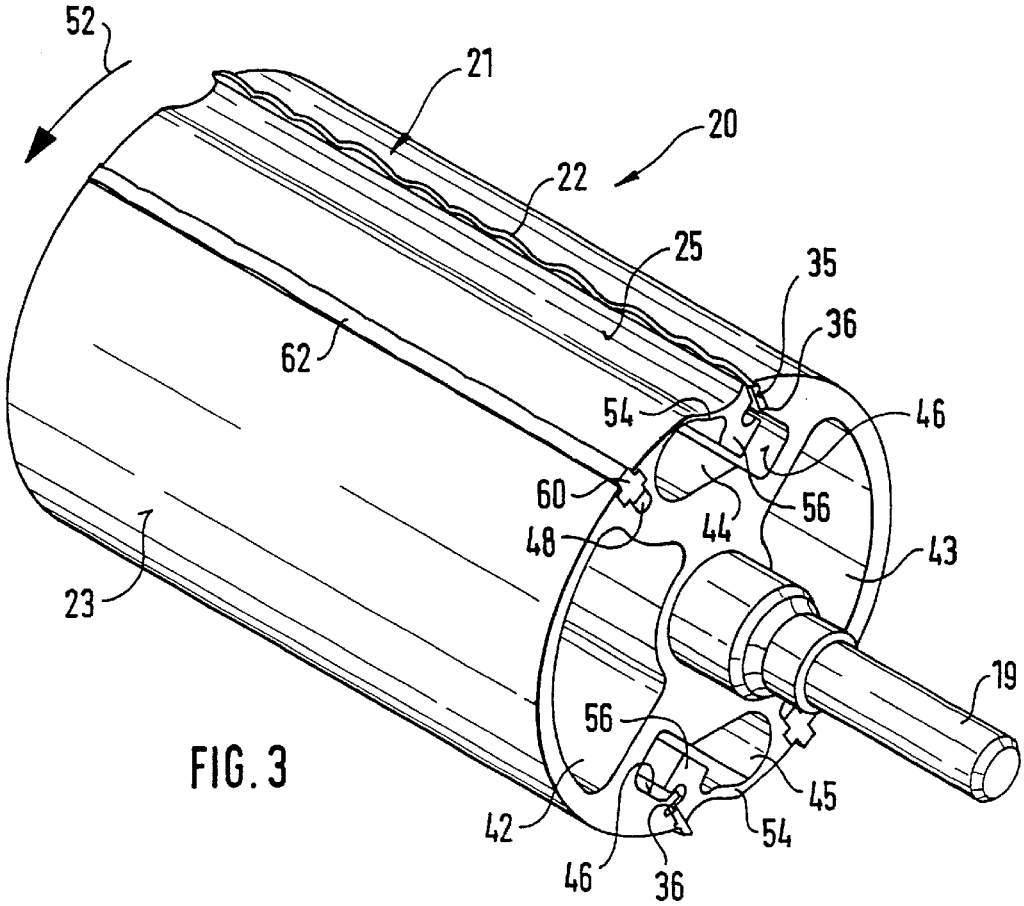
FIG. 3

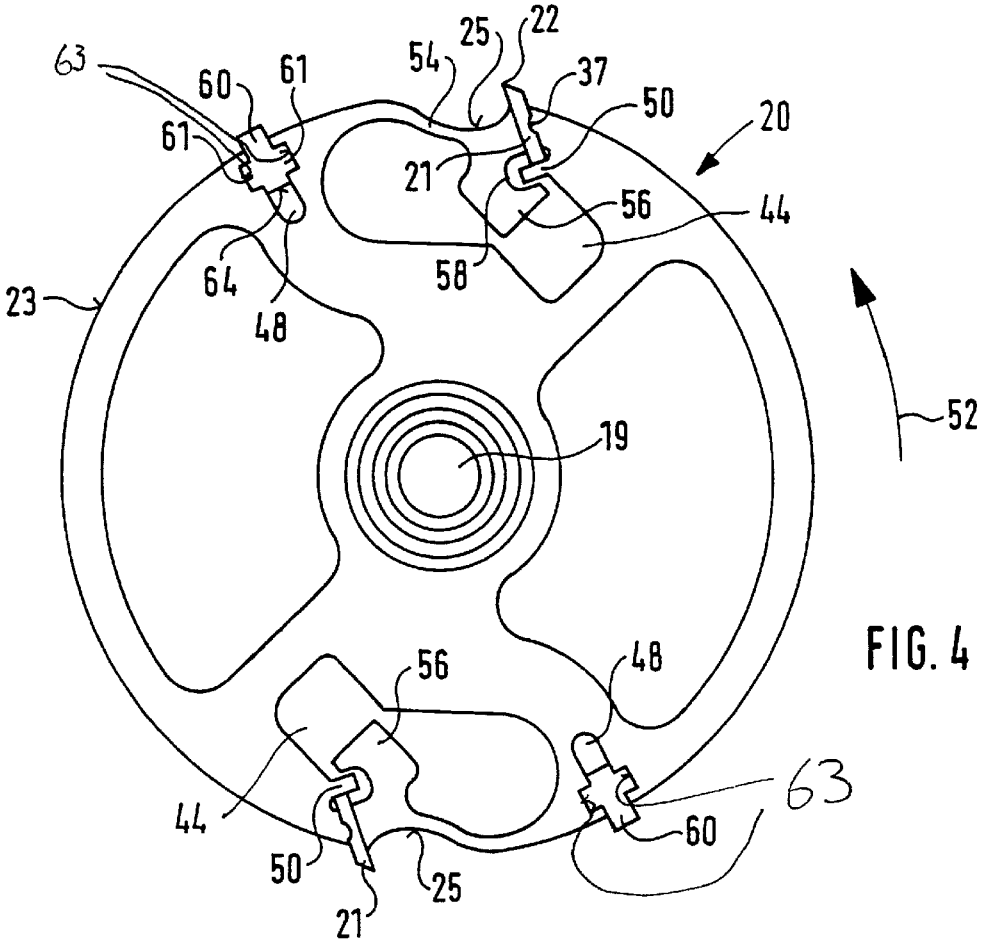
FIG. 4
FIG. 5
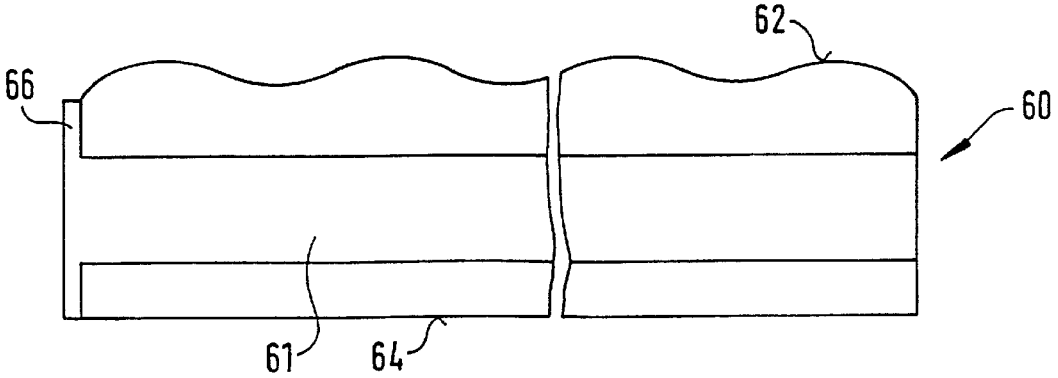

HAND PLANER

BACKGROUND OF THE INVENTION

The invention is based on a manual planing machine, a planer shaft, a planer knife and a spacer strip respectively.

DE-OS 91 52 65 discloses a planing machine with a cutter head or planer shaft whose elongated planer knives extend over the width of the planer shaft and can be clamped by clamping wedges which are carried by the planer shaft and are actuated by centrifugal force. The known planing machine is suitable only for clamping large-volume planer knives. The considerably smaller and thinner carbide mini reversible tips, e.g., in the standard size of 1.1 mm thickness and 5.5 mm height, cannot be clamped in any definite position in the known planing machines because they have a volume and mass roughly ten times smaller than the large-volume planer knives. The large-volume planer knife cannot be economically produced from carbide due to its large dimensions because the cost of carbide is very high, so that only high-speed steel planer knives of lesser stability and quality are considered for the known planers.

EP 01 17 991 discloses a planing machine with a planer shaft formed of profile disks, wherein a clamping wedge actuated by centrifugal force is arranged in the longitudinal groove of the planer shaft. This planer shaft is also not suitable for receiving mini reversible tips, but only for conventional high-power high-speed steel knives with an approximate thickness of 3 mm and a height of 11.5 mm. These would also be just as uneconomical as carbide knives in terms of construction.

Patent FR 2 477 460 discloses a clamping device at a planer shaft for large-volume rusticating planer knives with a corrugated cutter which, alternatively, can also receive dual-cutting straight mini reversible tips. For this purpose, a shavings or chip rejecting part is inserted in a longitudinal groove of the planer shaft, wherein this chip rejecting part is supported at the groove flank located in front of the planer knife in the direction of rotation and clamps the planer knife against the other groove flank. The chip rejecter has, on its side facing radially outward, a corrugated profile corresponding to the large-volume rusticating cutter profile.

If a mini reversible tip is to be clamped instead of the rusticating planer knife, clamping cannot be carried out exclusively by the clamping wedge, but rather an additional clamping body is needed which clamps itself—and, in so doing, also the mini reversible tip—between the clamping wedge and the outer groove flank.

Clamping wedges of the type mentioned above are complicated to produce and are accordingly expensive. Further, the rusticating knife clamping wedge must be exchanged with standard clamping wedges with a straight chip rejecting part when using straight planer knives because of the corrugated chip rejecting part. This complicates the exchanging of planer knives and, moreover, requires special storage for the different clamping wedges.

The corrugated chip rejecting part is necessary for limiting chip thickness because the maximum chip thickness in rusticating planer knives is appreciably thicker than in straight planer knives. This is because the thinnest chips generated by the corrugation troughs of the cutter must also still have a sufficient thickness for high surface quality. Therefore, the minimum chip thickness in rusticating knives is adapted to the minimum chip thickness of straight planer knives, wherein the maximum chip thickness must be about one millimeter thicker than the minimum chip thickness for the rusticated texture to be visually effective.

Since the risk of a back-kick increases with the chip thickness when working with the planer, the chip thickness is limited to a maximum 1.1 mm.

SUMMARY OF THE INVENTION

The planing machine, planer shaft, planer knife and spacer strip according to the invention have the advantage over the prior art that rusticating planer knives according to the invention can be clamped in the same manner as mini reversible tips in their standard clamping devices, so that there is no manufacturing cost for special outfitting for rusticating knives.

By refashioning series-produced mini reversible tip blanks with a thickness of 1.1 mm and a height of 5.5 mm as rusticating knives, they can be clamped with conventional screw clamping means, but can also be clamped by means of centrifugal force. Due to the fact that the constructional size is reduced by a factor of 10 compared with conventional high-speed steel rusticating knives, carbide rusticating knives can, for the first time, be produced inexpensively with a service life approximately ten-times longer than that of previous rusticating knives. Because of their small dimensions, the rusticating planer knives according to the invention have the advantage over previous large-volume rusticating planer knives that they save considerable weight.

A chip rejecting part for limiting chip thickness can be inserted in an additional, easily produced longitudinal groove of the planer shaft as a plastic strip without increasing weight. Therefore, the planer shafts, according to the invention, with centrifugal force clamping for mini reversible tips are suitable for producing rustically textured workpiece surfaces without resulting in substantially higher production costs than for previous planer shafts for straight dual-cutter mini reversible tips or for other straight planer knives.

A rusticating knife which is particularly simple to produce from mini reversible tips and, in addition, can be positioned radially in a particularly exact manner relative to the planer shaft, and in which changes in position brought about by clamping are eliminated is provided in that the planer knife carries only one effective cutter with corrugation troughs and corrugation crests, wherein the troughs lie on a common first straight line having the same parallel spacing relative to their back groove as straight standard cutters of conventional mini reversible tips relative to their back groove, and the crests lie on a common second straight line which extends 0.5 mm to 1.5 mm above the first straight line, and in that the planer knife carries a flattened contact edge instead of a second cutter at its side located opposite from the first cutter for support at the radial stop of the planer shaft, wherein the parallel spacing of the contact edge relative to the back groove is 0.5 to 1.5 mm smaller than the parallel spacing between the back groove and the opposite corrugation troughs. Therefore, the manual planers according to the invention can be produced more simply, more economically and so as to be more efficient. This advantage is also provided in that the planer knife with the corrugated cutter is 1.1 mm thick, 5.5 mm high and as wide as the planer shaft and is preferably made of carbide.

The planing machine and planer shaft are lighter and can be produced in a simpler manner in that another longitudinal slot is arranged parallel in front of the first longitudinal slot for receiving a spacer strip for limiting chip thickness.

The spacer strip can be arranged at the planer shaft so as to prevent its loss in that the longitudinal slot for receiving the spacer strip has a cross-shaped cross section with at least one shoulder recess. Compared with previous planer shafts, the spacer strip which is made of plastic results in reduced weight because the additional longitudinal slot reduces the mass of the planer shaft more than the spacer strip increases the total mass of the planer shaft.

Due to the fact that the outer edge of the spacer strip projecting over the outer contour of the planer shaft is corrugated and extends along a flight diameter which is 1 mm smaller than the cutter of the planer knife, its function as a chip thickness limiter is ensured. A slot closure which extends flush with the outer contour of the planer shaft and which is alternatively adjustable for limiting chip thickness is provided in that the edge of the spacer strip located opposite from the outer edge with the corrugated contour has a straight contour. Further, the spacer strip is also secured by the lateral shoulder against axial displacement and protected from falling out of the longitudinal slot.

BRIEF DESCRIPTION OF THE DRAWING

An embodiment example of the invention is explained more fully in the following with reference to the description and accompanying drawing.

FIG. 2 shows a top view of the back of a rusticating planer knife according to the invention;

FIG. 3 shows a three-dimensional view of a planer shaft, according to the invention, with rusticating planer knives;

FIG. 4 shows a side view of the planer shaft according to FIG. 3; and

FIG. 5 shows a spacer strip for limiting chip thickness for use in the planer shaft according to the invention.

DESCRIPTION OF THE PREFERRED Example

Figure 1:
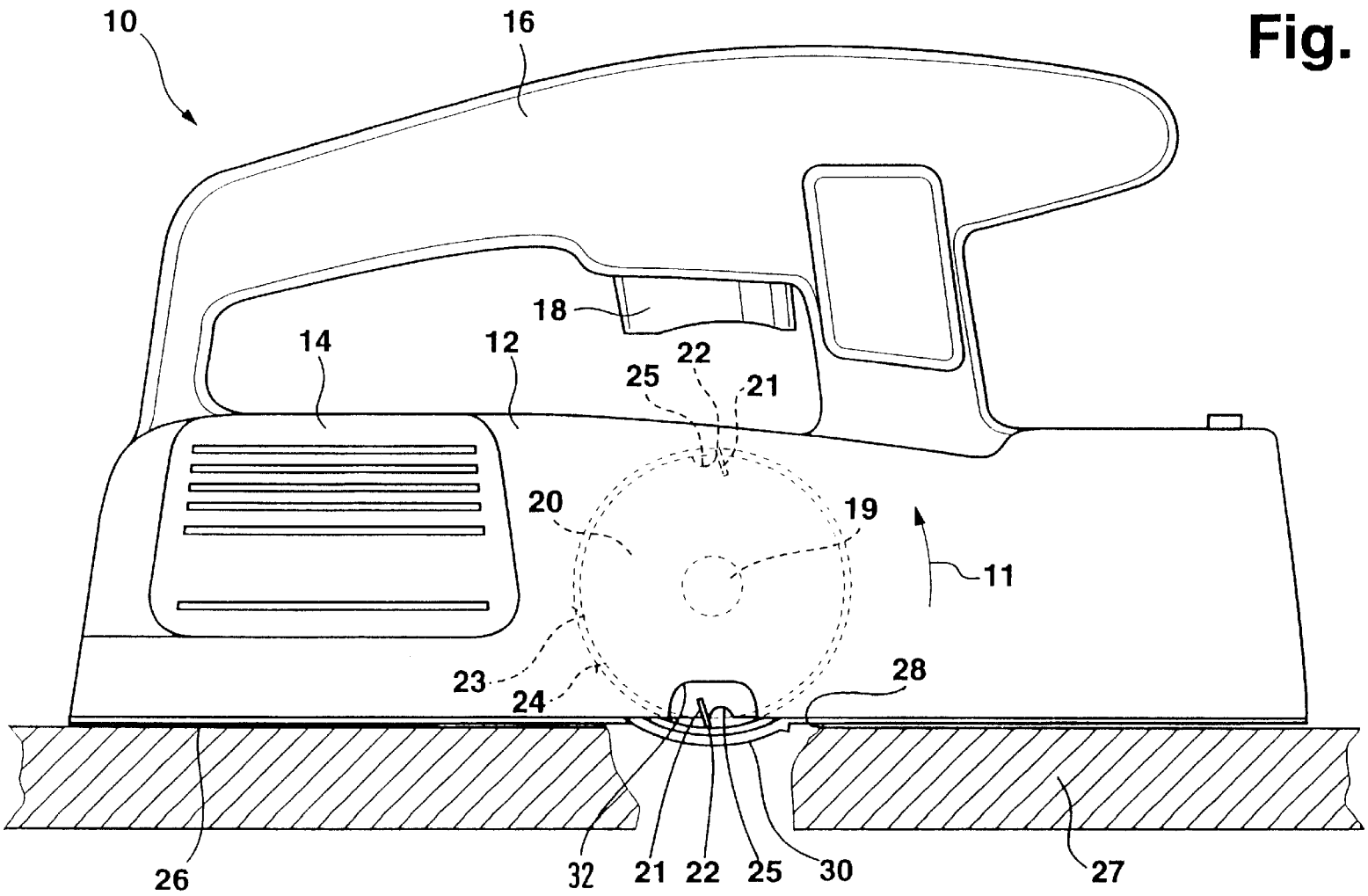
FIG. 1 shows a side view of the planer according to the invention.

The manual planing machine 10 shown in a side view in FIG. 1 is formed of a machine housing 12 with a motor housing 14 and a handle 16. The handle 16 carries an electric switch 18.

A planer shaft 20 is mounted in the machine housing 12 so as to be rotatable about its axis 19 in the direction of the arrow 11 indicating the rotating direction. This planer shaft 20 carries two planer knives 21, each having a corrugated (FIG. 2) cutter 2, in front of which chip grooves 25 are shaped into the outer contour 23 of the planer shaft 20.

During rotation of the planer shaft 20, the knives 21, with their cutters 22, determine a flight circle 24, shown in dash-dot lines, which projects over the base 26 of the manual planing machine 10, so that the cutters 22 can engage in a cutting manner in a workpiece 27 extending flush with the base 26. An opening 28 arranged in the base 26 for the passage of the cutters 22 at the bottom can be closed by means of a pendulum-type protective hood 30. The latter closes the opening 28 automatically as soon as the manual planing machine 10 is lifted from the workpiece 27. This reduces the risk of injury to the user on the rotating cutters 22.

The machine housing 12 has lateral recesses 32 at both sides of the planer shaft 20 in the area of the base 26 through which, from the side, the planer knives 21 can be removed from the planer shaft 20 or inserted therein for clamping. By means of centrifugal wedges 56, which will be described in the following with reference to FIG. 3, the planer knives 21 are automatically clamped in a reliable manner when the manual planer 10 is put into operation.

A view of the planer knife 21 from the back shown as a detail in FIG. 2 shows its corrugated contoured cutter 22 with crests 38 and troughs 39. The crests 38 lie on a common straight line 0 and the troughs 39 lie on a common straight line U. A back groove 35 which serves to engage over a longitudinal rib 37 (FIG. 4) of the planer shaft 20 runs in the center of the back 34 along its entire length. A center line C of the back groove 35 is the reference line for the degree of spacing a, b with respect to the common straight line U of the troughs 39 and with respect to the contact edge 36 on the side located opposite from the cutter 22.

The planer shaft 20 shown in the three-dimensional view in FIG. 3 has a substantially circular outer contour 23. To reduce weight, the planer shaft 20 forms a hollow section with two symmetrical, oppositely located, axially parallel recesses 42, 43, 44, 45. Because of their special contour which opens radially outward into a longitudinal slot 46 at one location in each instance, each of the recesses 44, 45 forms a portion of the planer shaft 20 which passes into a centrifugal wedge 56 via a leaf spring 54. The planer knives 21 which are formed as thin mini reversible tips are mounted on two sides located radially opposite one another in the longitudinal slots 46, wherein the cutters 22, the back groove 35 and the contact edge 36 can be seen clearly.

The planer knives 21 are clamped in the longitudinal slot 46 of the planer shaft 20 between groove flanks, not shown in more detail. The longitudinal slot 46 proceeds radially inward from the outer contour 23, via a longitudinal rib 37 (FIG. 4) engaging in the back groove 35 of the planer knife 21, into a right-angled transverse step 50 projecting in a straight line. Following the latter, the longitudinal slot 46 widens out toward the recess 44. This is designed in such a way that an area of the planer shaft 20 which is thinner toward the outer contour 23 forms a leaf spring 54 which becomes thicker toward a centrifugal wedge 56.

The centrifugal wedge 56 engages around the projection 50 with a catch groove 58 and, with its straight side which leads radially outward, forms the left flank of the longitudinal slot 46 which passes radially outward into the chip groove 25. This flank is arranged at an angle such that there is no self-locking between the centrifugal wedge 56 and the planer knife 21 when the centrifugal wedge 56 contacts the flat side of the planer knife 21. The centrifugal wedge 56 accordingly always returns again to its release position because there is no longer any centrifugal force as soon as the planer shaft 20 is at a standstill. This facilitates exchange of planer knives.

The catch groove 58 enclosing the transverse step 50 defines the radial stroke of the centrifugal wedge 56 inward and outward to prevent overstretching of the leaf spring 54. The pretensioning of the leaf spring 54 is selected in such a way that the planer knife 21 cannot change its axial position with respect to the longitudinal slot 46 in an unwanted manner or fall out when the planer shaft 20 is stopped. By inserting a screwdriver blade or hexagon shaft into the area of the recess 44 on the right-hand side considered in the viewing direction, the centrifugal wedge 56 can be swiveled radially inward and the centrifugal wedge 56 accordingly occupies its release position in which the planer knives 21 slide out of the longitudinal slot 46 automatically in the vertical position of the planer shaft 20 or planer 10.

FIG. 4 shows a side view of the planer shaft 20, wherein the axle 9 of the planer shaft 20 carries the planer shaft body.

The planer shaft 20 carries the planer knife 21 with the corrugated cutter 22 at top in the viewing direction. This planer knife 21, also called a rusticating planer knife, has the same outer dimensions as mini reversible tips with straight cutters and can easily be exchanged for straight cutters of this type.

It can be seen clearly in FIGS. 3, 4 how the planer knife 21 is supported by its flattened contact edge 36 on the radial inside at the transverse step 50 projecting vertical to the planer knife 21. This makes possible a particularly safe radial positioning of the cutter 22 and accordingly also an accurate adjustment of the flight circle 24. The longitudinal rib 37 serves only to engage in the back of the planer knife 21 as is conventional with mini reversible tips in order to prevent it from exiting the longitudinal slot 46 unintentionally.

If a dual-cutter mini reversible tip is clamped in the planer shaft 20 instead of the rusticating planer knife 21, its cutter on the radial inner side contacts the transverse step 50, which ensures that the radial outer cutter is positioned especially accurately.

Formerly, a contact edge directed diagonally corresponding to the cutting angle of the mini reversible tip was used instead of a transverse step, wherein even small manufacturing defects were sufficient to lead to considerable radial positional deviations of the radial outer cutter. The transverse step 50 makes possible a particularly reliable and exact positioning of the planer knife 21.

Another longitudinal slot 48 with a cross-shaped cross section which is open on the radial outer side is arranged following the arrow 52 indicating the rotating direction at the left of the planer knife 21 considered in the viewing direction, wherein a spacer strip 60 can be inserted into the cross section so as to prevent it from falling out. The spacer strip 60 is corrugated on its radial outer edge 62 and has a straight contour on its radial inner edge 64. On the right-hand and left-hand side, the spacer strip 60 carries a shoulder 61 for positive engagement in the cross-shaped longitudinal slot 48. The spacer strip 60 can be reversed in that its corrugated side which was previously located on the outer side is now located on the radial inside, and wherein the straight edge 64 terminates flush with the outer contour 23 of the planer shaft 20.

FIG. 5 shows the spacer strip 60 as a detail viewed on the longitudinal side. The corrugated edge 62 located on the radial outer side during operation with the rusticating planer knife 21 can be seen clearly, as can the shoulders 61. The left side of the spacer strip 60 considered in the viewing direction is formed as an end piece 66 which is widened in a T-shaped manner and which, when inserted farther into the longitudinal slot 48, prevents further axial displacement of the spacer strip 60 and accordingly fixes its axial position relative to the planer shaft 20.

What is claimed is:

1. A manual planing machine, comprising a planer housing; a planer shaft carried by said planer housing and having at least one longitudinal slot of such a configuration that said longitudinal slot can fittingly receive only planer knives of mini reversible tip type; an elongated flat planer knife clamped in a detachable manner in said at least one longitudinal slot, said planer knife having only one cutting edge located on one side thereof and a back groove extending parallel to said cutting edge, said planer shaft having a holding rib on a side of said longitudinal slot said back groove engaging said holding rib to prevent an unintentional detachment from said planer shaft; at least one stop provided at a side of said longitudinal slot and formed so that said planer knife is supported on said at least one stop radially for fixing said cutting edge on a provided flight circle, said cutting edge extending in a corrugated manner in such a way that troughs of said cutting edge lie on a common first straight line having a same spacing relative to said back groove as a cutting edge of the planer knife of a mini reversible tip type while crests of said cutting edge lie on a common second straight line which extends 0.5–1.5 mm radially above said first straight line, said planer knife having a contact edge which is flattened and right-angled relative to a back side of the planer knife cutting edge, said contact edge being provided on a side of the planer knife located opposite to said one side of the planer knife for support at said radial stop of said planer shaft.

2. A manual planing machine as defined in claim 1, wherein said contact edge has a parallel spacing relative to said back groove which is 0.5–1.5 mm smaller than a parallel spacing between said back groove and said opposite corrugation troughs.

3. A manual planing machine as defined in claim 1, wherein said stop is arranged at a side of said longitudinal slot so as to project forward at a right angle, said contact edge of said planar knife extending substantially parallel to said stop.

4. A manual planing machine as defined in claim 1, wherein said planar knife is 1.1 mm thick, 5.5 mm high, and essentially as long as said planar shaft is wide, said planar knife being composed of a material selected from a group consisting of carbide and high-power high-speed steel.

5. A manual planing machine comprising a planer housing: a planer shaft carried by said planer housing and having at least one longitudinal slot of such a configuration that said longitudinal slot can fittingly receive only planer knives of a mini reversible tip type, an elongated flat planer knife clamped in a detachable manner in said at least one longitudinal slot, said planer knife having only one cutting edge provided on one side thereof and a back groove extending parallel to said cutting edge, said planer shaft having a holding rib on a side of said longitudinal slot, said back groove engaging said holding rib to prevent an unintentional detachment from said planer shaft; at least one stop provided at a side of said longitudinal slot and formed so that said planer knife is supported on said at least one stop radially for fixing said cutting edge on a provided flight circle, said cutting edge extending in a corrugated manner in such a way that troughs of said cutting edge lie on a common first straight line having a same spacing relative to said back groove as a cutting edge of the planer knife of a mini reversible tip type while crests of said cutting edge lie on a common second straight line which extends 0.5–1.5 mm radially above said first straight line, said planer knife having a contact edge which is flattened and right-angled relative to a back side of the planer knife, said contact edge being provided on a side at the planer knife located opposite to said one side of the planer knife for support at said radial stop of said planer shaft; and an additional longitudinal slot arranged substantially parallel to said longitudinal slot and having a cross-section with at least one shoulder recess; and further comprising a spacer strip received in said additional longitudinal slot.

6. A manual planing machine as defined in claim 5, wherein said spacer strip is composed of plastic and has a cross-shaped cross-section so that it is insertable into said additional longitudinal slot and is prevented from falling out.

7. A manual planing machine as defined in claim 5, wherein said spacer ring has one outer edge having a corrugated contour and projects over an outer contour of said planar shaft when inserted into said additional longitudinal slot, said one outer edge of said spacer extending along a flight diameter which is 1 mm smaller than said cutter of said planar knife.

8. A manual planing machine as defined in claim 7, wherein said spacer ring has an outer edge which is located opposite to said outer edge with said corrugating contour and has a straight contour, said outer edge with said straight contour extending flush with said outer contour of said planar shaft when inserted into said additional longitudinal slot so as to face radially outwards.

9. A manual planing machine as defined in claim 5, wherein said spacer rib has at least one lateral shoulder for securing against axial displacement and for preventing falling out of said longitudinal slot.

10. A manual planing machine as defined in claim 1; and further comprising an additional longitudinal slot arranged parallel to said longitudinal slot viewed in a rotating direction of said planar shaft and having a cross-shaped cross-section with at least one shoulder recess; and a spacer strip received in said additional longitudinal slot.

11. A planer knife for a manual planing machine, having only one cutting edge provided one the side thereof, said planer knife including a back groove extending parallel to said cutting edge, and a contact edge provided on a side of the planer knife opposite to said one side, said cutting edge extending in a corrugated manner in such a way that troughs thereof lie on a common first straight line having a same spacing relative to said back groove, said cutting edge also having crests which are located on a common second straight line extending 0.5–1.5 mm radially above said first straight line; said contact edge being formed as a right-angle contact edge which is flattened relative to a back side of the planer knife for supporting at a radial stop of a planer shaft.

12. A planar knife as defined in claim 11, wherein said contact edge has a parallel spacing relative to said back groove of 0.5–1.5 mm smaller than a parallel spacing between said back groove and said corrugation troughs.

13. A planar knife as defined in claim 12, wherein said planar knife is 1.1 mm thick, 5.5 mm high, and as wide as said planar shaft, said planar knife being composed of a material selected from the group consisting of carbide and high-power high-speed steel.

14. A spacer strip for insertion into a planer shaft of a manual planing machine, said spacer strip having a strip element composed of plastic and having a cross-shaped cross-section such that it is insertable into a longitudinal slot of the planer shaft so as to be prevented from falling out, wherein said strip element has a corrugated contour and projects over an outer contour of the planer shaft when inserted into the longitudinal slot, said strip element extending along a flight diameter which is approximately 1 mm smaller than a cutting edge of the planer knife.

15. A planar knife as defined in claim 14, wherein said strip element has an edge which is located opposite to an outer edge with a corrugated contour and has a straight contour, said edge extending flush with an outer contour of the planar shaft when inserted into an additional longitudinal slot.

16. A planar knife as defined in claim 14, wherein said strip element has at least one lateral shoulder preventing it from falling out of the longitudinal slot.

* * * * *